US008282411B2

(12) United States Patent
Itzenhuiser et al.

(10) Patent No.: US 8,282,411 B2
(45) Date of Patent: Oct. 9, 2012

(54) CONNECTOR POSITION ASSURANCE LOCK

(75) Inventors: William Alex Itzenhuiser, Naperville, IL (US); Armando Jaquez, Bolingbrook (IL); Jeffrey Drye, Glendale Heights, IL (US)

(73) Assignee: International Engine Intellectual Property Company, LLC., Lisle, IL (US)

( * ) Notice: Subject to any disclaimer, the term of this patent is extended or adjusted under 35 U.S.C. 154(b) by 404 days.

(21) Appl. No.: 12/715,154

(22) Filed: Mar. 1, 2010

(65) Prior Publication Data

US 2011/0212644 A1 Sep. 1, 2011

(51) Int. Cl.
*H01R 3/00* (2006.01)

(52) U.S. Cl. ..... 439/489; 439/352; 439/372

(58) Field of Classification Search ..... 439/157, 439/489, 352, 372
See application file for complete search history.

(56) References Cited

U.S. PATENT DOCUMENTS

| | | | | |
|---|---|---|---|---|
| 5,006,078 | A | 4/1991 | Crandall | |
| 5,910,027 | A * | 6/1999 | Wayt et al. | 439/489 |
| 6,189,511 | B1 | 2/2001 | Dzierzawski | |
| 6,439,914 | B2 * | 8/2002 | Nimura | 439/352 |
| 6,896,538 | B2 * | 5/2005 | Grubbs | 439/352 |
| 6,921,279 | B2 * | 7/2005 | Sian et al. | 439/352 |
| 7,118,403 | B1 | 10/2006 | Drye | |
| 8,016,606 | B1 * | 9/2011 | Kwan et al. | 439/352 |
| 2007/0197081 | A1 * | 8/2007 | Patterson et al. | 439/372 |

* cited by examiner

*Primary Examiner* — Hien Vu
(74) *Attorney, Agent, or Firm* — Mark C. Bach; Jeffrey P. Calfa

(57) ABSTRACT

A Connector Position Assurance (CPA) lock (10) for an engine wiring harness connector (12) having a connector body (14) and a lever latch (30) pivotal with respect to the connector body includes a lock body (34). A foot (52) extends from the lock body (34) and engages the connector (12) to fix the position of the lock body relative to the connector. The lock body (34) captures the lever latch (30) and prevents the pivoting of the lever latch with respect to the connector body (40) unless the foot (52) is deformed.

4 Claims, 2 Drawing Sheets

CONNECTOR POSITION ASSURANCE LOCK

BACKGROUND

Embodiments described herein relate to a device and method for locking a connected position of a connector on an engine harness.

Engine wiring harnesses are used to connect switches, sensors and solenoids to control modules, lamps and gauges, and typically include connectors, terminals, protective coverings and clipping features. The engine wiring harness provides the engine with the electrical power to start-up and run, while also supplying any electrical signals to and from the engine control module, such as electrical signals to the speedometer and tachometer, among others.

The connectors on the engine wiring harness may include a lever latch pivotally disposed on a connector body. The lever latch is pivotal with respect to the connector body at a pivot point. When the lever latch is pivoted from a first, unconnected position to a second, connected position, the connector has a positive connection with the object that it is being connected to. The second, connected position should be maintained by the lever latch for the positive connection to be maintained.

To prevent the connector from inadvertently disengaging, the connector sometimes includes a lock, known as a connector position assurance (CPA) lock. CPA locks typically provide a mechanical lock that avoids inadvertent disengagement of the connector from the second, connected position, but that permits intended disengagement of the connector.

SUMMARY

A Connector Position Assurance (CPA) lock for an engine wiring harness connector having a connector body and a lever latch pivotal with respect to the connector body includes a lock body. A foot extends from the lock body and engages the connector to fix the position of the lock body relative to the connector. The lock body captures the lever latch and prevents the pivoting of the lever latch with respect to the connector body unless the foot is deformed.

A method of locking the position of a lever latch that is pivotally disposed on a connector body of an engine wiring harness connector includes the step of providing a connector position assurance (CPA) lock. The CPA lock has a body with a deformable surface and a foot extending from the lock body. The method also includes the steps of engaging the foot with the connector to fix the position of the lock body relative to the connector, pivoting the lever latch rearward away from a front surface of the connector body, and deforming the lock body to permit the lever latch to pivot over a top surface of the lock body. Additionally, the foot is returned to an un-deformed state, and the lever latch is captured in the pivoted position by the un-deformed foot.

A Connector Position Assurance (CPA) lock for an engine wiring harness connector having a connector body and a lever latch pivotal with respect to the connector body includes a generally annular lock body. The lock body has a top surface, a bottom surface, and two side-walls connecting the top surface and the bottom surface. The top surface, the bottom surface and the two side-walls define an aperture extending from a front face to a rear face of the lock body. Two flexible feet extend from the side walls of the lock body, and extend rearward from the rear face to engage with the connector. A lip is disposed on the top surface of the lock body at the rear face of the lock body, and is configured to receive and engage the lever latch.

DETAILED DESCRIPTION

Figure 1:
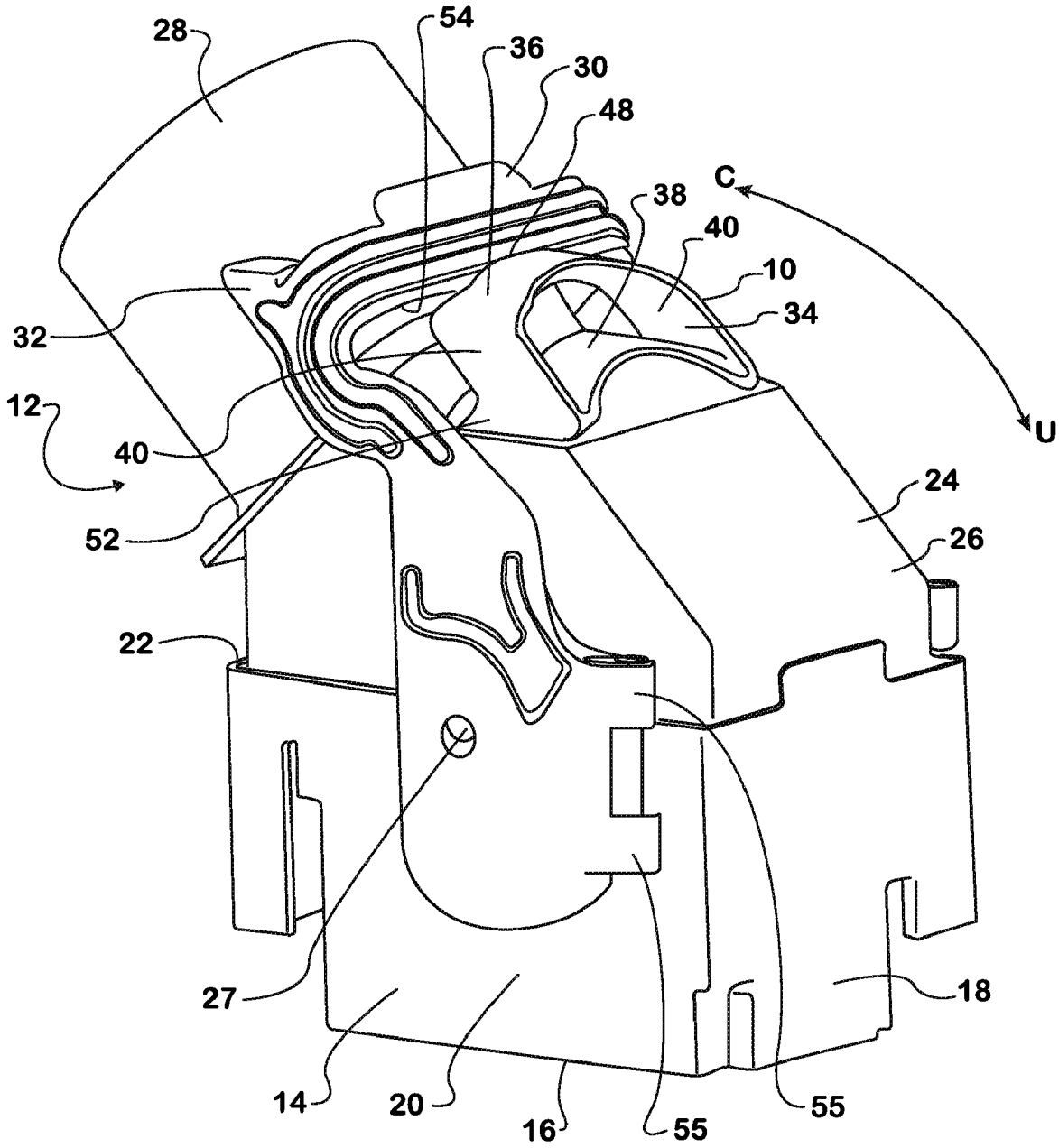
FIG. 1 is a perspective view of a connector including a connector position assurance lock.
Figure 2:
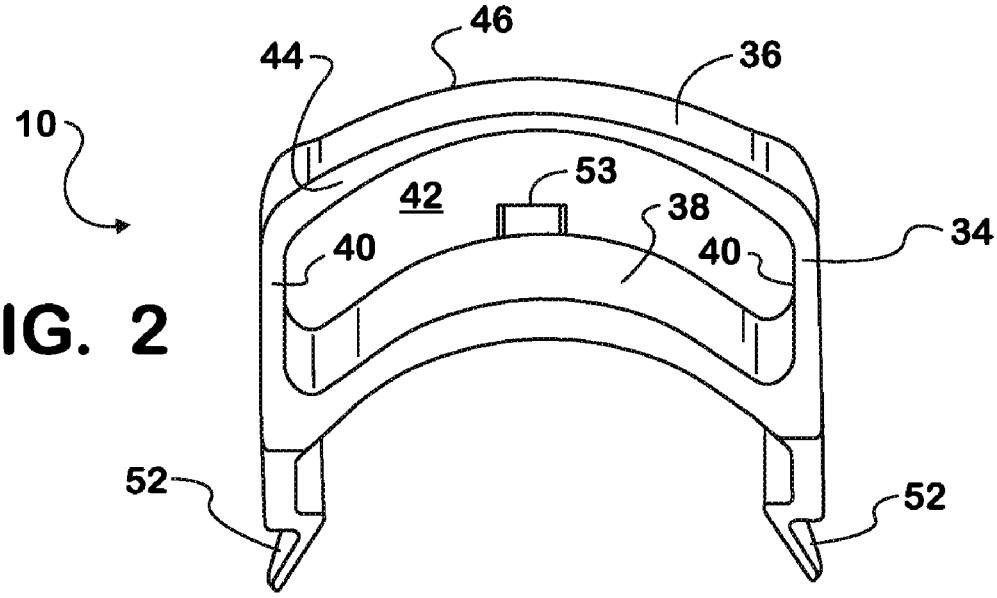
FIG. 2 is a front view of the connector position assurance lock.
Figure 3:
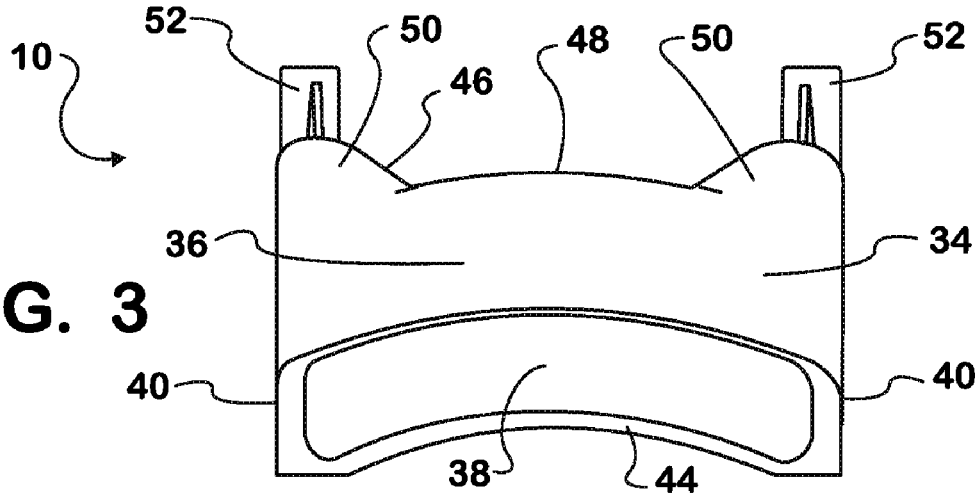
FIG. 3 is a top view of the connector position assurance lock.
Figure 4:
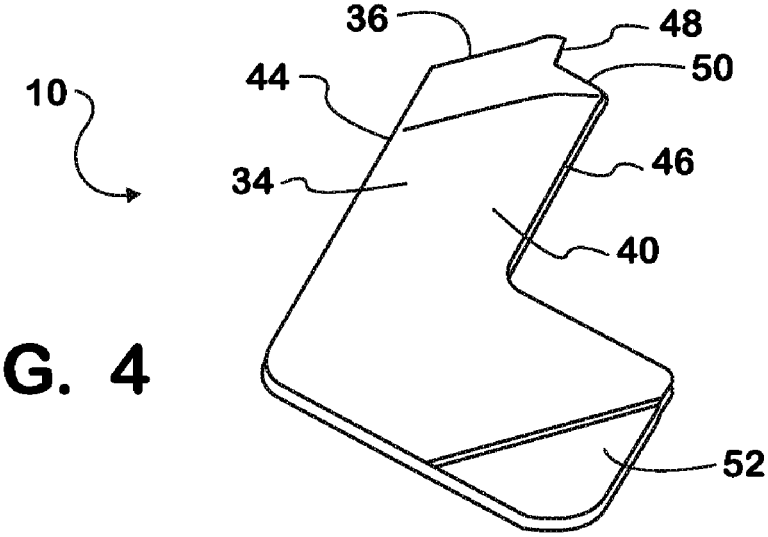
FIG. 4 is a side view of the connector position assurance lock.

Referring to FIGS. 1-4, a Connector Position Assurance (CPA) lock is indicated at 10 and is shown engaged with a connector 12 of an engine wiring harness. The connector 12 is one known connector available commercially under the BOSCH® brand, however the CPA lock 10 can be used with various other connectors used on engine wiring harnesses.

The connector 12 on the engine wiring harness includes a connector body 14 having a generally rectangular shape, however other shapes are possible. The connector body 14 has a lower surface 16 that interfaces with the engine, for example at an engine control module (ECM), a front surface 18 and at least one side surface 20. Extending from an upper surface 22 of the connector body 14 is a back cover 24. The back cover 24 may be plastic, however other materials are possible. A lower portion 26 of the back cover 24 is proximate the connector body 14, and an upper portion 28 of the back cover 24 may be generally cylindrical, although other shapes are possible. The upper portion 28 may bundle wires extending from the connector 12 to the engine wiring harness.

A lever latch 30 is pivotally disposed on the connector body 14 at a rotational point 27 located on the side surface 20. The lever latch 30 may be metal, however other materials are contemplated. The lever latch 30 is pivotal towards the front surface 18 of the connector body 14, and away from the front face of the connector body. When the lever latch 30 is pivoted to the position shown in FIG. 1, the connector 12 is connected. The lever latch 30 includes a latch engagement feature 55 that captures posts on a header of the ECM. As the lever latch 30 is pivoted away from the front surface 18 of the connector body 14, there is a camming action that pulls the connector 12 into engagement with the ECM.

When the lever latch 30 is pivoted from a first, unconnected position (shown by arrow "U") to a second, connected position (shown in FIG. 1), the connector 12 has a positive connection with the ECM, electrically coupling the ECM to the engine wiring harness. The second, connected position "C" needs to be maintained by the lever latch 30 for the positive connection to be maintained. While a latch lock 32 may be disposed on the lever latch 30 to lock the lever latch in the connected position, the latch lock 32 has been found to be unreliable in maintaining the lever latch 30 in the connected position.

The CPA lock 10 mechanically locks the lever latch 30 in the connected position. The CPA lock 10 has a lock body 34 that may be generally annular, having a top surface 36 and a bottom surface 38. Both the top surface 36 and the bottom surface 38 may be generally curved, for example following the curvature of the back cover 24, however other shapes are possible. While both the top surface 36 and the bottom surface 38 have generally the same curved-shape, it is possible that the lock body 34 can have other shapes. Side walls 40 that are generally perpendicular to the top surface 36 and the bottom surface 38 join the top surface and the bottom surface, defining an aperture 42 formed between a front face 44 and a rear face 46 of the lock body 34.

A lip 48 is defined generally centrally at the rear face 46 of the top surface 36, and two ears 50 are disposed on the top surface on either side of the lip. Two feet 52 extend from the side walls 40 of the lock body 34, and extend rearward from the rear face 46 to engage with the back cover 24. The two feet 52 are flexible to attach to the back cover 24, and once engaged with the back cover, the CPA lock 10 is not easily removed from the back cover. The two feet 52 fix the position of the lock body 34 relative to the connector 12. It is also possible that one foot 52, or more than two feet, can be used.

The two feet 52 are configured to deform or flex to allow the lock body 34 to deform or displace. In an alternative embodiment, it is possible that other portions of the CPA lock 10 can deform, for example the top surface 36. A protrusion 53 (see FIG. 2) may be located on the bottom surface 38 beneath the top surface 36 to limit the deflection of the top surface and the lip 48.

As the lever latch 30 is pivoted, and before the lever latch is engaged behind the lip 48, the two feet 52 are deformed, which deforms, displaces and/or deflects the top surface 36, allowing the lever latch to pass over the top surface 36 and to be engaged behind the lip in a connected and locked position. When mounted on the connector 12, the top surface 36 of the lock body 34 may have an incline until reaching the lip 48. With the incline, the lever latch 30 travels up and over the top surface 36 until reaching the rear face 46 and lip 48. When the lever latch 30 is pivoted to the connected position, the lever latch 30 is locked by engaging the lever latch behind the lip 48. Alternatively, it is possible that the CPA lock 10 can be attached to the connector 12 after the lever latch 30 is pivoted to the connected position.

When the lever latch 30 is engaged behind the lip 48 and the two feet 52 are returned to the un-deformed state, the lever latch is captured between the lip and the back cover 24 in the connected and locked position. In this connected and locked position, there may be a gap 54 between the lever latch 30 and the upper portion 28 of the back cover 24. The gap 54 may be about 3 mm, although other gaps or no gap are possible.

When the connector 12 is to be unlocked, the two feet 52 are flexed or deformed by the user to permit the lever latch 30 to disengage from the lip 48 and pivot towards the front surface 18 of the connector body 14. The CPA lock 10 may make a physical or audible click, that when sensed by the user, informs the user of the deformation of the CPA lock that is occurring.

The CPA lock 10 may be formed of plastic, such as nylon resins, or any other resilient materials, and may be formed as a single piece, or alternatively, formed in multiple pieces. To account for variances between the lever latch 30 and the back cover 24, the CPA lock 10 may be formed of a robust material. Further, the CPA lock 10 may be a different color than the connector 12, for example since connectors are commonly grey or black, the CPA lock may be red or orange, or any other color that provides a contrast against the connector or back shell.

The CPA lock 10 is configured such that it does not interfere with the wires going to the connector 12. Additionally, the CPA lock 10 can be installed and used without tools, and the CPA lock can be used with different types of connectors 12. Using the CPA lock 10 may increase the detection of unsuccessful connections at the connectors 12.

What is claimed is:

1. A Connector Position Assurance (CPA) lock for an engine wiring harness connector having a connector body and a lever latch pivotal with respect to the connector body, the CPA lock comprising:

a lock body with a deformable surface;

a foot extending from the lock body and configured to be engaged with the connector to fix the position of the lock body relative to the connector;

wherein the lock body captures the lever latch and prevents the pivoting of the lever latch with respect to the connector body unless the foot is deformed, wherein the lock body comprises a top surface disposed between a front face and a rear face of the lock body, the top surface includes a lip that is configured to receive and engage the lever latch of the connector in a connected position, the lock body is generally annular and comprises a top surface, a bottom surface and two sidewalls defining an aperture between the top surface, the bottom surface and the two sidewalls, the foot comprises two feet extending from the sidewalls of the lock body, and the two feet extend rearward from the rear face of the lock body to engage with the connector, the two feet are flexible, the top surface and the bottom surface are curved, and the top surface and the bottom surface generally have the same curvature.

2. The CPA lock of claim 1 wherein the lock body and the foot are integrally formed.

3. The CPA lock of claim 1 wherein the lock body and the foot are formed of nylon resin.

4. A connector position assurance (CPA) lock for an engine wiring harness connector having a connector body and a lever latch pivotal with respect to the connector body, the CPA lock comprising:

a generally annular lock body with a deformable surface having a top surface, a bottom surface, and two sidewalls connecting the top surface and the bottom surface, wherein the top surface, the bottom surface and the two side-walls define an aperture extending from a front face to a rear face of the lock body;

two flexible feet extending from the side-walls of the lock body, and extending rearward from the rear face to engage with the connector; and a lip disposed on the top surface of the lock body at the rear face of the lock body, the lip configured to receive and engage the lever latch of the connector in a connected position, wherein the top surface is inclined from a front face to the lip at the rear face, the lock body, the two flexible feet and the lip are integrally formed, the lock body, the two flexible feet and the lip are formed of nylon resin, the top surface and the bottom surface are curved, and wherein the top surface and the bottom surface generally have the same curvature.

* * * * *